US006209998B1

(12) United States Patent
Yue

(10) Patent No.: US 6,209,998 B1
(45) **Date of Patent: *Apr. 3, 2001**

(54) TREATMENT OF IMAGE PRINTED WITH PIGMENTED INK TO ENHANCE GLOSS

(75) Inventor: Shunqiong Yue, San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/707,539

(22) Filed: Sep. 4, 1996

(51) Int. Cl.[7] ..... B41J 2/01
(52) U.S. Cl. ..... 347/102
(58) Field of Search ..... 347/96, 98, 101, 347/102; 106/31.61

(56) References Cited

U.S. PATENT DOCUMENTS

| | | | | |
|---|---|---|---|---|
| 4,832,984 | * | 5/1989 | Hasegawa et al. | 427/161 |
| 4,844,633 | * | 7/1989 | Greenberg | 400/120 |
| 4,940,744 | * | 7/1990 | Tortorici et al. | 524/437 |
| 5,517,214 | * | 5/1996 | Bhatia et al. | 346/25 |
| 5,568,173 | * | 10/1996 | Leenders et al. | 347/96 |
| 5,574,078 | * | 11/1996 | Elwakil | 523/161 |
| 5,635,969 | * | 6/1997 | Allen | 347/96 |

FOREIGN PATENT DOCUMENTS 53-27426 * 3/1978 (JP) .

* cited by examiner

*Primary Examiner*—John Barlow
*Assistant Examiner*—Raquel Yvette Gordon

(57) ABSTRACT

A high gloss pigmented surface is formed in an inkjet printer by first applying a liquid pigmented ink in the form of a liquid suspension medium containing individual particles of pigment and a suitable binder onto a smooth surface of a sheet of print medium to thereby form a printed image, then drying (fixing) the printed image by evaporating or absorbing the suspension medium until the pigment has adhered to the smooth surface of the print medium in the form of clumps of particles having a rough top surface, and then heating the rough top surface until it has softened and flowed together to form a high gloss pigmented layer having a smooth upper surface. Preferably, a relatively low level of heat is applied for a relatively long time to the liquid ink and the print medium to thereby speed up the evaporating or absorption of the suspension medium, and then a relatively high level of heat is applied for a relative short period of time to heat the surface of the already fixed image without burning or distorting the underlying print media, thereby providing the image with the desired high gloss finish. In one practical embodiment, the ink is applied by an inkjet printing mechanism which applies and fixes the printed image as a sequence of individual horizontal image swaths, using unheated ambient temperature air to dry and fix each individual horizontal swath of the image as the ink is being applied, and the high heat level is produced by a jet of heated air directed against the upper surface of the print medium as a separate step after the entire image has been printed and fixed.

12 Claims, No Drawings

TREATMENT OF IMAGE PRINTED WITH PIGMENTED INK TO ENHANCE GLOSS

TECHNICAL FIELD

The present invention relates generally to printing glossy images, and more particularly to a process for increasing the gloss of an image printed with a liquid ink.

BACKGROUND ART

Photographic and other high definition images are conventionally reproduced with a uniform, high gloss surface that enhances the clarity and sharpness of the image. Pigmented inks are desirable for inkjet printers because they can be used on a variety of print media to produce saturated, opaque colors, and are typically more permanent and have greater resistance to ultra-violet light than dye-based inks. However, especially when applied to a print medium with a smooth (glossy) surface, pigmented inks tend to produce an image whose inked portions have a relatively low gloss in comparison with either the surrounding print medium or the corresponding portions of an image printed with dye-based inks. This low gloss is believed to be the result of the ink being deposited on the smooth surface of the glossy paper as loosely packed clumps of discrete pigmented particles held together by a polymeric binder, thereby resulting in a rough (low gloss) surface texture in the inked portions the image. This clumping effect is exacerbated in certain types of aqueous ink systems in which ionic forces normally disperse the individual particles of pigment in a liquid suspension medium, but cause certain combinations of pigmented particles to combine into even larger precipitates.

It is known to apply heat to the liquid ink before and during the printing process to thereby speed up the rate at which the suspension medium can be evaporated or absorbed and the ink thereby becomes sufficiently dry that the printed image will not be subject to smearing when it comes into contact with the printer mechanism or with previously printed media. However, a rapid loss of solvent or other suspension medium encourages the individual particles of pigment to flocculate into distinct clumps rather than remaining dispersed within a more or less homogenous layer.

Conventional print-zone heating not only exacerbates the undesirable clumping of the pigmented particles, but can also cause glossy paper to form undesirable wrinkles at all but the lowest heat settings, particularly when the heat source is a heating element below the print medium.

DISCLOSURE OF INVENTION

A high gloss pigmented surface is formed by first applying a liquid pigmented ink an aqueous or other a liquid suspension medium containing individual particles of pigment and an appropriate binder onto a smooth surface of a sheet of print medium to thereby form a printed image, then drying (fixing) the printed image by evaporating or absorbing the suspension medium until the pigment has adhered to the smooth surface of the print medium as a loss ieted lyer having a rough top surface comprising loosely packed clumps of discrete pigmented particles held together by a binder, and then heating the rough top surface of the pigmented layer until at least some of the particles at respective outer surfaces of the clumps of pigment at the top of the pigmented layer have softened and flowed together to form a high gloss pigmented layer having a smooth upper surface.

Preferably, a relatively low level of heat is applied for a relatively long time to the liquid ink and the print medium to thereby speed up the evaporating or absorption of the suspension medium, and then a relatively high level of heat is applied for a relative short period of time to heat the surface of the already fixed image without burning or distorting the underlying print media, thereby providing the image with the desired high gloss finish.

In one practical embodiment, the ink is applied by an inkjet printing mechanism which applies and fixes the printed image as a sequence of individual horizontal image swaths, using unheated air to dry and fix each individual horizontal swath of the image as the ink is being applied, and the high heat level is produced by a jet of heated air directed against the upper surface of the print medium as a separate step after the entire image has been printed and fixed.

The invention may also be applicable to pigmented inks without binders, and to other types of printed images having an upper surface that smooths out when heated.

PREFERRED MODE FOR PRACTICING THE INVENTION

In an experiment intended to simulate the invention and to provide a quantitative measurement of its efficacy, a number of color squares each approximately 3×3 cm in area were printed with a conventional ink-jet printer on a letter size sheet of commercially available (HP brand) glossy paper using a 4-pass unidirectional print mode (in which each forward traverse of the carriage causes ink to be applied to every other pixel on every other line). The tests were made with two different proprietary formulations of ink in which the cyan component exhibited pronounced surface roughness when used in conventional print processes, which was even more pronounced in secondary colors in which the cyan was mixed with other primary colors. One formulation contained a linear binder and the other contained a latex binder. The ink was applied with 100% coverage (one drop of ink per pixel) for primary colors (eg, cyan) and 200% coverage (one drop of each of two colors of ink) for secondary colors (eg, blue=cyan+magenta and green=cyan+yellow).

The printed image was air dried under standard laboratory conditions (approx 23° C. and 55% humidity); no print-zone or preheater was used. A conventional 1000 watt hair dryer was used to provide a jet of heated air that was applied to the surface of the printed image to simulate a post-heater stage for heating the surface after the entire image was printed and fixed. Heating was done for 10–15 seconds.

The following gloss readings were taken at a 60° angle, using a BYK Gardner Micro-TRI-gloss meter. The indicated measurements are based on a relative scale in which 0 corresponds a highly diffusive surface that completely scatters a collimated beam of light, and 100 corresponds to a highly reflective surface in which a collimated beam of light is reflected completely as specular light.

| Gloss | Ink with Linear Binder, without Post-Heat | Ink with Linear Binder, with Post-Heat | Ink with Latex Binder, without Post-Heat | Ink with Latex Binder, with Post-Heat |
|---|---|---|---|---|
| Cyan | 58 | 70 | 67 | 74 |
| Green | 36 | 42 | 42 | 45 |
| Blue | 36 | 40 | 43 | 47 |

From the above test measurements, it can be seen that post-heating increases the apparent gloss of both primary and secondary colors by at least about 10%, for both formulations of ink, but that the improved gloss is especially noticeable in the inks with the linear binder.

The brief heating of the image surface caused by exposure to the hot (50° C.–150° C.) jet of air is believed to temporarily soften or reduce the viscosity (or modulus) of the upper portion of the pigmented layer, thereby allowing the intermolecular forces (surface tension) at the surface to produce a smooth, high gloss surface.

Particularly notable is that the present invention provides the means to increase gloss of printed images even without changes in ink formulation. Moreover, since the heat is preferably applied from above and only the upper portion of the ink layer needs to be softened, the underlying print medium is not adversely affected.

In a practical embodiment, it is contemplated that the ink will be applied by the inkjet printing mechanism as a sequence of individual horizontal image swaths, using only unheated air to dry and fix each individual horizontal swath of the image as the ink is being applied, and the high heat level will be produced by a jet of heated air directed against the upper surface of the print medium in the output tray after the entire image has been printed and fixed. Alternatively, the hot air could be applied to the upper surface while the print medium was still inside the printer and/or the upper surface could be softened by radiant heat rather than by convection. It should be understood that the foregoing embodiments are merely exemplary, and that the principles of the present invention are believed to be applicable to other ink systems, such as pigmented inks without binders and dye-based inks on media having a water soluble top coat. In either case, the application of heat to the top surface of the image after the image has been fixed is expected to result in a smoother and therefore more glossy surface.

What is claimed is:

1. A method of forming a high gloss pigmented surface on a sheet of glossy print medium, comprising the steps:

applying to a sheet of print medium a sufficient amount of liquid pigmented ink to form a printed image, said sheet of print medium having a smooth upper surface for reflecting light and said liquid pigmented ink having a plurality of particles of pigment for helping to reflect specular light;

applying a sufficient first amount of heat for a sufficient first period of time to said liquid pigmented ink to cause loosely packed clumps of discrete pigmented particles to adhere to said smooth upper surface in a first pigmented layer, said pigmented layer having a rough upper surface with a relatively low gloss in comparison with the smooth upper surface of the print medium, but not a sufficient amount of heat to cause said smooth upper surface of said sheet of print medium to be heat distorted; and then applying a sufficient second amount of heat for a sufficient second period of time to cause said rough upper surface to soften and form a second pigamented layer, having a relatively smooth upper surface for reflecting substantially specular light with a relatively high gloss in comparison with the rough upper surface of the first pigmented layer;

wherein said first sufficient period of time is substantially longer than said second sufficient period of time.

2. The method of claim 1, wherein:

the ink is applied by an inkjet printing mechanism which applies and fixes the printed image as a sequence of individual horizontal swaths of the image, each individual horizontal swath is separately heated to thereby fix a corresponding portion of the printed the image, and heat is thereafter applied to the entire upper surface of the already fixed image such that the image is provided with a desired high gloss finish without burning or distorting the underlying print media.

3. The method of claim 2, wherein the relatively low gloss is not more than about 67, and the relatively high gloss is at least 110 percent of the first gloss.

4. The method of claim 3, wherein the recited numerical ranges for the relatively low gloss and the relatively high gloss fare correspond to measurements made at a 60° angle, using a BYK Gardner Micro-TRi-gloss meter, based on a relative scale in which a gloss value of "0", corresponds a highly diffusive surface that completely scatters a collimated beam of light, and in which a gloss value of "100" corresponds to a highly reflective surface in which a collimated beam of light is reflected completely as specular light.

5. The method of claim 2, wherein the relatively low gloss is not more than about 58 and the relatively high gloss is at least 70.

6. The method of claim 5, wherein the recited numerical ranges for the relatively low gloss and the relatively high gloss correspond to measurements made at a 600 angle, using a BYK Gardner Micro-TRI-gloss meter, based on a relative scale in which a gloss value of "0" corresponds a highly diffusive surface that completely scatters a collimated beam of light, and in which a gloss value of "100" corresponds to a highly reflective surface in which a collimated beam of light is reflected completely as specular light.

7. The method of claim 2, wherein the relatively low gloss is not more than about 36.

8. The method of claim 7, wherein the recited numerical ranges for the relatively low gloss and the relatively high gloss fare measured correspond to measurements made at a 60° angle, using a BYK Gardner-Micro-TRI-gloss meter, based on a relative scale in which a gloss value of "0" corresponds a highly diffusive surface that completely scatters a collimated beam of light, and in which a gloss value of "100" corresponds to a highly reflective surface in which a collimated beam of light is reflected completely as specular light.

9. The method of claim 2, wherein the heat is provided in the form of a jet of heated air directed against the upper surface of the print medium.

10. The method of claim 2, wherein a lower level of heat is applied during the first said heating step and a higher level of heat is applied during the second said heating step.

11. The method of claim 1, wherein the ink contains a polymeric binder for holding together the loosely packed clumps of discrete pigmented particles.

12. The method of claim 1, wherein the ink is an aqueous ink system in which a plurality of pigmented particles are combined into a precipitate.

* * * * *